US007401424B2

(12) United States Patent
Kerns et al.

(10) Patent No.: US 7,401,424 B2
(45) Date of Patent: Jul. 22, 2008

(54) COMPOSITE OUTSOLE

(75) Inventors: Mark Kerns, Golden, CO (US); Christopher J. King, Boulder, CO (US); Kurtis Sakai, Ventura, CA (US)

(73) Assignee: DashAmerica, Inc., Louisville, CO (US)

( * ) Notice: Subject to any disclaimer, the term of this patent is extended or adjusted under 35 U.S.C. 154(b) by 218 days.

(21) Appl. No.: 10/710,476

(22) Filed: Jul. 14, 2004

(65) Prior Publication Data

US 2006/0010716 A1 Jan. 19, 2006

(51) Int. Cl.
*A43B 5/00* (2006.01)

(52) U.S. Cl. ..... 36/131; 36/3 B; 36/31; 36/15

(58) Field of Classification Search ..... 36/3 B, 36/3 R, 30 R, 31, 131, 15
See application file for complete search history.

(56) References Cited

U.S. PATENT DOCUMENTS 3,310,889 A 3/1967 Samuels
3,522,669 A * 8/1970 Simons ..... 36/67 A
4,833,796 A * 5/1989 Flemming ..... 36/134
4,845,864 A 7/1989 Corliss
4,942,677 A 7/1990 Flemming et al.
5,086,576 A 2/1992 Lamson
5,154,682 A 10/1992 Kellerman
5,337,492 A 8/1994 Anderie et al.
5,406,723 A 4/1995 Okajima
5,628,129 A * 5/1997 Kilgore et al. ..... 36/134
5,636,456 A 6/1997 Allen
5,678,327 A 10/1997 Halberstadt
5,761,831 A 6/1998 Cho
5,836,094 A 11/1998 Figel
5,940,994 A * 8/1999 Allen ..... 36/168
6,079,125 A 6/2000 Quellais et al.
6,477,793 B1 11/2002 Pruitt et al.
6,505,424 B2 1/2003 Oorei et al.
6,601,042 B1 7/2003 Lyden
6,742,286 B2 * 6/2004 Giovale ..... 36/7.6
6,922,917 B2 8/2005 Kerns et al.
6,948,262 B2 9/2005 Kerrigan
6,948,264 B1 9/2005 Lyden
7,016,867 B2 3/2006 Lyden
7,100,309 B2 9/2006 Smith et al.
7,107,235 B2 9/2006 Lyden
7,219,450 B2 5/2007 Langley
2002/0062578 A1 * 5/2002 Lussier et al. ..... 36/59 R
2002/0095820 A1 * 7/2002 Giovale ..... 36/7.6
2003/0088996 A1 5/2003 Hall
2004/0107601 A1 * 6/2004 Schmid ..... 36/28
2005/0166422 A1 8/2005 Schaeffer et al.
2005/0198868 A1 9/2005 Scholz

* cited by examiner

*Primary Examiner*—Jila M. Mohandesi
(74) *Attorney, Agent, or Firm*—Dorsey & Whitney LLP

(57) ABSTRACT

A composite outsole including a carbon fiber portion and a titanium portion. The titanium portion is molded to the carbon fiber portion using adhesives and the like. The titanium portion provides increased strength and ductility to allow for additional features in the outsole, such as, for example, air flow vents that increase circulation for breathability and moisture management as well as reduce drag.

14 Claims, 6 Drawing Sheets

COMPOSITE OUTSOLE

BACKGROUND OF INVENTION

Numerous cycling shoes exist on the market for cyclists of all abilities. FIG. 1 shows a conventional cycling shoe 100. Cycling shoe 100 comprises an upper 102 coupled to an outsole 104. Outsole 104 and upper 102 are coupled or lasted using conventional techniques. Upper 102 frequently has a tightening system 106, which is shown as a series of straps 106 or equivalent that extend from outsole 104 and anchor the outsole 104 to the shoe 100. Straps 106 frequently are coupled a fastening system 108. Fastening system 108 is used to tighten the shoe about the foot of a cyclist. Fastening system 108 can be a series of straps having hook and pile (or hook and loop) material, or other closure systems, such as a canopy closure system described in U.S. patent application Ser. No. 10/631,572, titled SHOE TIGHTENING SYSTEM, filed Jul. 30, 2003, and incorporated herein by reference. A fabric 110 typically covers upper 102 and underlies fastening system 108. Fabric 110 preferably is a breathable fabric, such as, a mesh, or open cell foam fabric, but could be other types of breathable fabrics or moisture management fabrics as are generally known in the art, such as, for example, polyesters, nylons, blends, or the like. Upper 102 also has a heel 112. Heel 112 may be a wear resistant fabric, such as, leather or canvas, but frequently is a molded plastic or other material as is known in the art.

Outsole 104 comprises a heel portion 120, a forefoot portion 122, and a toe portion 124. Outsole 104 also has an upper surface 126 approximate upper 102 and a lower surface 128 opposite upper surface 126. As shown in FIG. 2, shoe 100 may have one or more studs 200 coupled to outsole 104. Also, shoe 100 have a pedal connect part 202, as is generally known in the art.

Conventionally, outsole 104 is an integral unit formed from carbon fiber material. Instead of carbon fiber, some outsoles 104 are formed of high density, rigid plastics, such as, for example, ABS or PVC. Conventional carbon fiber outsoles have slots, holes, or other connection points to faciliate coupling studs 200 or cleats to outsole 104.

While conventional outsoles 104 are function, they suffer many drawbacks. Thus, it would be desirous to develop an improved outsole for athletic shoes.

FIELD OF THE INVENTION

The present invention relates to composite outsole and, more particularly, to an athletic shoe outsole comprising a carbon portion and a titanium portion.

SUMMARY OF INVENTION

To attain the advantages and in accordance with the present invention, a shoe with a composite outsole is provided. The composite outsole comprises a carbon fiber portion and a titanium portion. The titanium portion is molded to the carbon fiber portion using adhesives and the like. The titanium portion provides increased strength and ductility to allow for additional features in the outsole, such as, for example, air flow vents that increase air circulation for breathability and moisture management as well as reduce drag.

The foregoing and other features, utilities and advantages of the invention will be apparent from the following more particular description of a preferred embodiment of the invention as illustrated in the accompanying drawings.

BRIEF DESCRIPTION OF DRAWINGS

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

The present invention will now be described with reference to FIGS. 1-7. While the present invention is described with particular reference to an outsole used with a cycling shoe, one of ordinary skill in the art will recognize on reading the disclosure, that the composite outsole could be used with other shoes, such as, for example, track shoes, baseball shoes, football, shoes, soccer shoes, golf shoes, or the like. These examples to other athletic shoes are exemplary and non-limiting.

Figure 1:
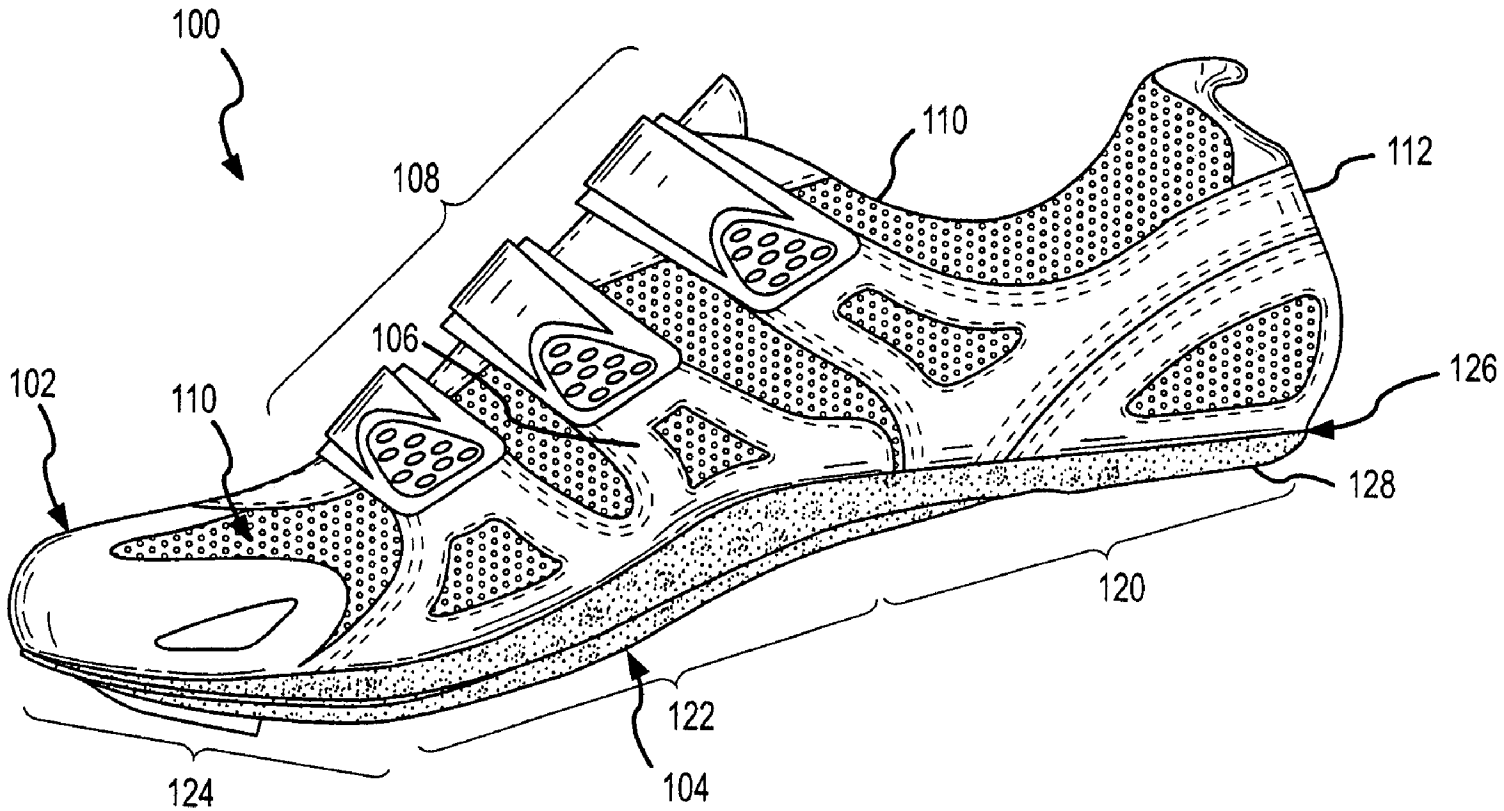
FIG.1 PRIOR ART
FIG. 1 is a side elevation view of a conventional cycling shoe.
Figure 2:
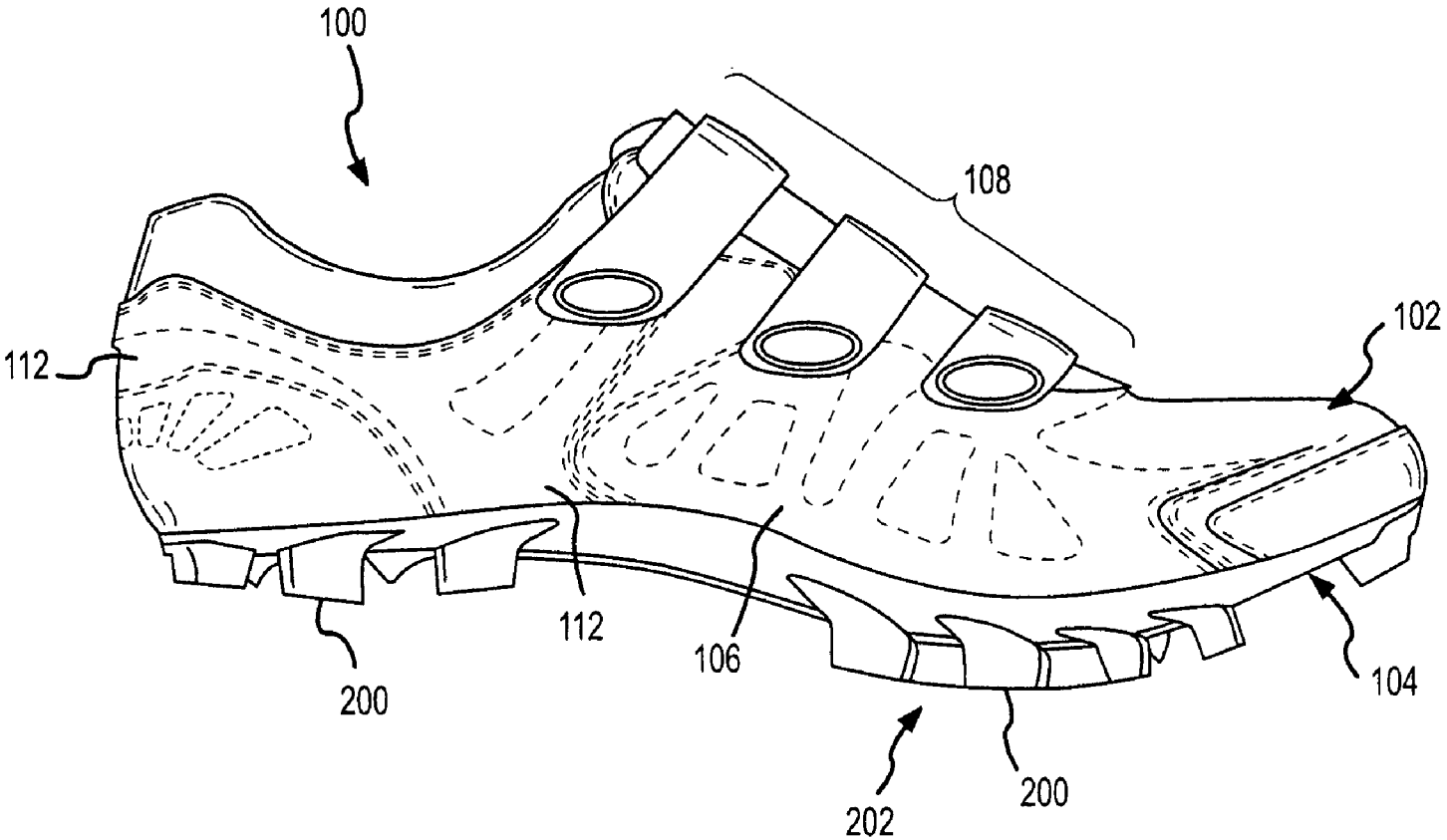
FIG.2 PRIOR ART
FIG. 2 is side elevation of the conventional cycling shoe shown in FIG. 1 with studs.
Figure 3:
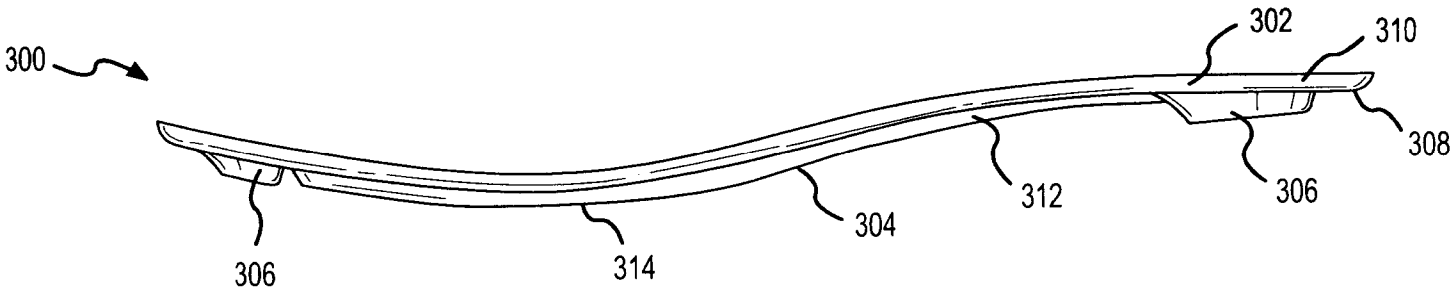
FIG. 3 is a side elevation view of a composite outsole consistent with an embodiment of the present invention.

Referring first to FIG. 3, outsole 300 is shown. Outsole 300 could be coupled to upper 102 in place of outsole 104, as shown in FIG. 1. Outsole 300 includes a carbon portion 302 and a titanium portion 304. Carbon portion 302 is typically molded carbon fiber, but could be other carbon composites. Outsole 300 may have one or more studs 306 attached, generally to the carbon portion 302 using conventional techniques, such as, for example, slots or holes in carbon portion 302. Studs 306 could be connected to carbon portion 302 in a manner similar to attaching titanium portion 304 to carbon portion 302 as explained in more detail below as well. Outsole 300 can be contoured similar to a conventional outsole such that, carton portion 302 includes a carbon bottom 308 and an up-turned outer rim 310. Titanium portion 304 also has an outer wall 312 extending below carbon bottom 308 to a Ti bottom 314.

Figure 4:
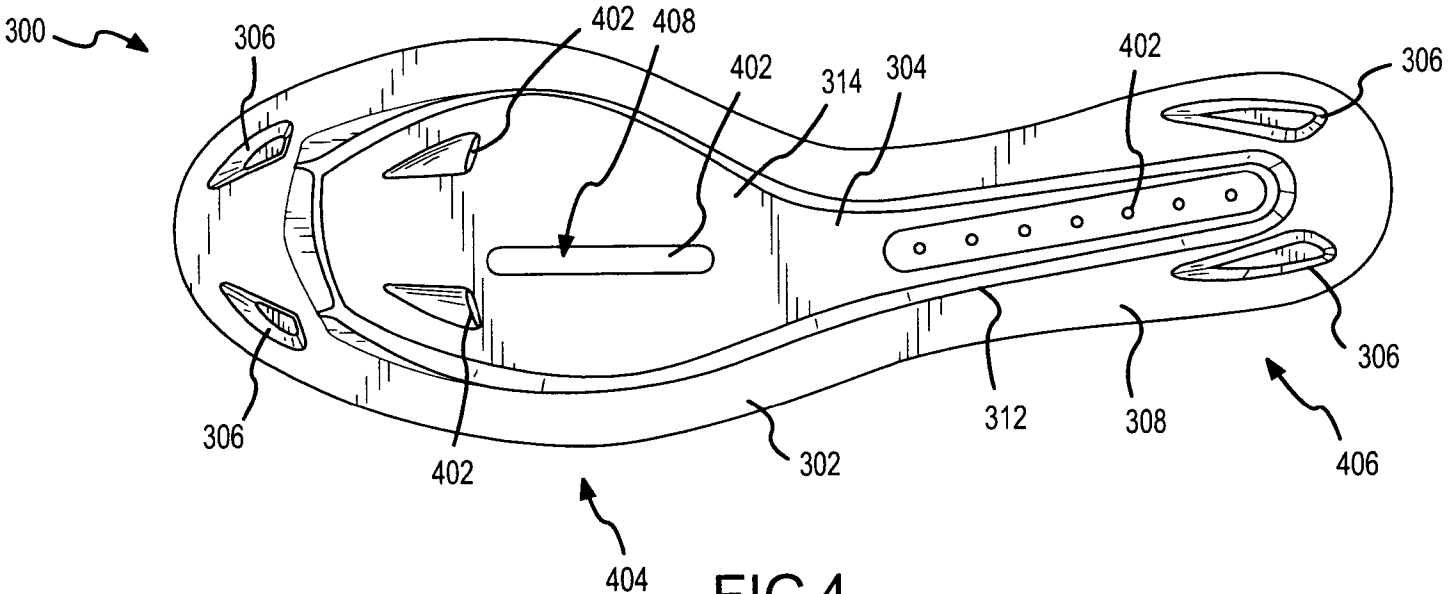
FIG. 4 is a bottom plan view of the composite outsole of FIG. 3 consistent with an embodiment of the present invention.

Referring now to FIG. 4, a bottom plan view of outsole 300 is shown. As best seen in FIG. 4, Ti bottom 314 has a plurality of holes 402. Holes 402 provide an airflow path to allow air circulation, which increase breathability and reduce drag. While holes 402 can be placed anywhere on Ti bottom 314, it is preferable to place at least one hole 402 in a toe area 404 and at least one hole 402 in a heel area 406. As can be appreciated, wall 312 and Ti bottom 314 define a generally open area or volume 408. Area 408 is open to provide air flow, but may be substantially filled in if desired. In other words area 408 only needs to provide an air flow path A (best seen in FIG. 5) from intakes to exhausts.

Figure 5:
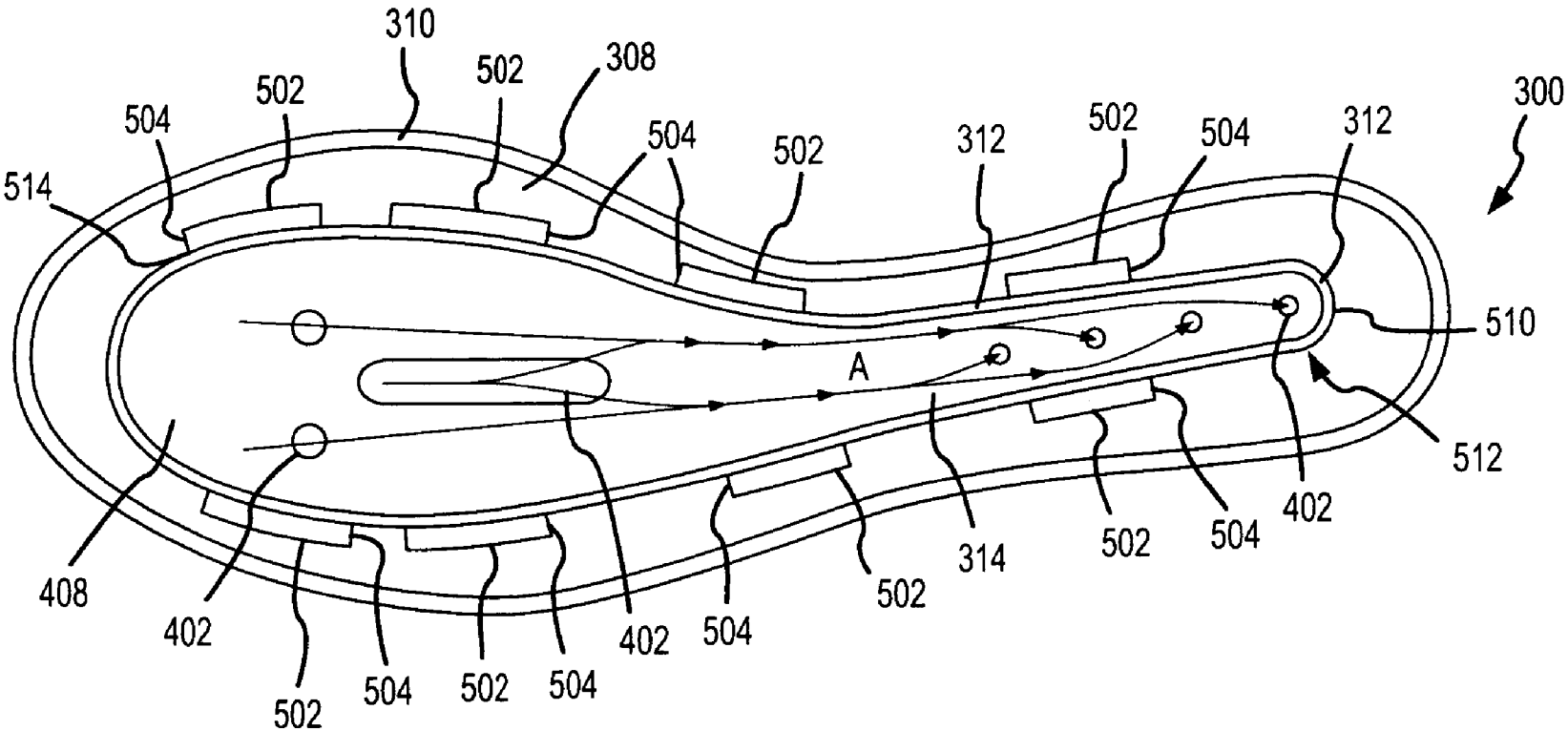
FIG. 5 is a top plan view of the composite outsole of FIG. 3 consistent with an embodiment of the present invention.

Referring now to FIG. 5, a top plan view of outsole 300 is provided. As best seen in FIG. 5, outsole 300 has one or more air flow paths as shown by arrow A. While arrows A show a possible air flow path, air circulation in volume 408 would not be constrained to the particular path shown, but suggest to typical fluid mechanics. Further, volume 408 could be partially filled with channels left for airflow.

Figure 6:
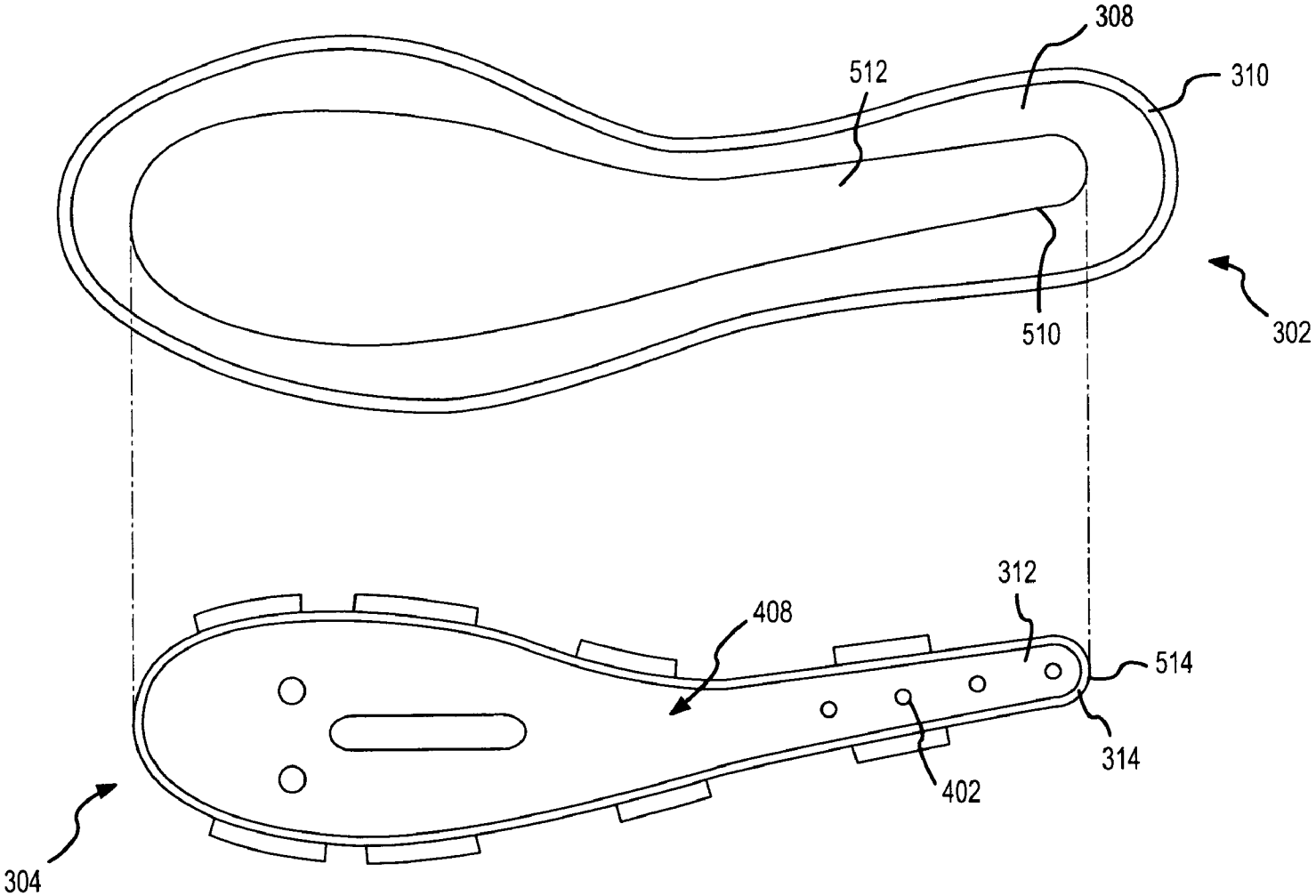
FIG. 6 is a side-by-side exploded view of the carbon fiber portion and the titanium portion of the composite outsole of FIG. 3 consistent with an embodiment of the present invention.

As shown, carbon bottom 308 has an inner edge 510 defining an opening 512 into which titanium portion 304 fits. In particular, outer wall 312 has a top edge 514 proximate inner edge 510. Tabs 502 extend radially outward from top edge 514 over inner edge 510 and over a portion of carbon bottom 308. An adhesive layer 504 between tabs 502 and carbon bottom 308 couples titanium portion 304 to carbon portion 302. FIG. 6 is identical to FIG. 5, but shows carbon portion 302 and titanium portion 304 in side-by-side orientation for clarity.

Figure 7:
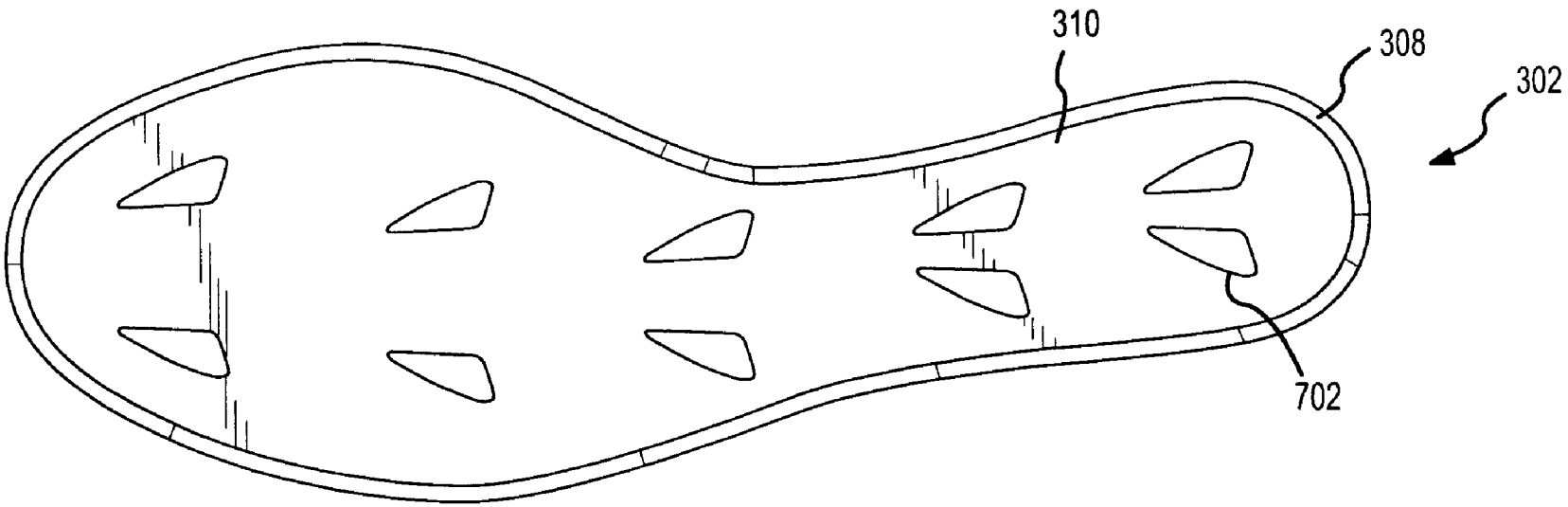
FIG. 7 is an alternative carbon fiber portion of the composite outsole consistent with an embodiment of the present invention.

FIG. 7 shows an alternative arrangement for carbon portion 302. Instead of carbon bottom 308 having an inner edge 510 defining an opening 512, carbon bottom 308 may be substantially solid with a plurality of slots 702. The plurality of slots 702 substantially align with tabs 502, such that tabs 502 coupled to titanium portion 304 extend through slots 702 and extend over a portion of carbon bottom 308. Adhesive 504 would still couple titanium portion 304 to carbon portion 302. In this embodiment, tabs 502 could extend radially outward as shown in FIGS. 5 and 6, or they could extend radially inward, or a combination thereof.

While the invention has been particularly shown and described with reference to a preferred embodiment thereof, it will be understood by those skilled in the art that various other changes in the form and details may be made without departing from the spirit and scope of the invention.

We claim:

1. An athletic shoe, comprising:
an upper;
a sole coupled to the upper;
the sole comprising a carbon portion and a titanium portion coupled to the carbon portion;
the titanium portion comprising:
a bottom including a perimeter; and
an outer wall extending from the bottom along at least a substantial portion of the perimeter;
a plurality of holes in the titanium portion;
at least one of the plurality of holes resides in a toe section of the sole and at least one other of the plurality of holes resides in a heel section of the sole, such that the at least one hole in the toe section acts as an air intake and the at least one other hole in the heel section acts as an air exhaust;
the carbon portion comprising:
a carbon bottom;
an up turned outer rim;
an inner edge; and
the inner edge defines an opening; and
the outer wall has a top edge proximate the inner edge.

2. The athletic shoe of claim 1, wherein the carbon portion comprises molded carbon fiber.

3. The athletic shoe of claim 1, further comprising at least one stud; and
the at least one stud is coupled to the carbon portion.

4. The athletic shoe of claim 1, wherein:
the outer wall and the titanium bottom define a volume.

5. An athletic shoe, comprising:
an upper;
a sole coupled to the upper;
the sole comprising a carbon portion and a titanium portion coupled to the carbon portion;
the carbon portion comprises a carbon bottom, an up turned outer rim, and an inner edge;
the inner edge defines an opening;
the titanium portion comprises an outer wall and a titanium bottom;
the outer wall has a top edge;
the top edge is proximate the inner edge; and
the titanium portion further comprises at least one tab;
the at least one tab coupled to the top edge; and
the at least one tab extends radially outward over the inner edge and the carbon bottom.

6. The athletic shoe of claim 5, wherein the titanium portion is coupled to the carbon portion by an adhesive residing substantially between the at least one tab and the carbon bottom.

7. An athletic shoe, comprising:
an upper;
a sole coupled to the upper;
the sole comprising a carbon portion and a titanium portion coupled to the carbon portion;
the carbon portion comprises a carbon bottom an up turned outer rim, and at least one slot in the carbon bottom;
the titanium portion comprises an outer wall and a titanium bottom;
the outer wall has a top edge;
the top edge is proximate the carbon bottom;
the titanium portion further comprises at least one tab coupled to the top edge; and
the at least one tab is substantially aligned with the at least one slot such that the at least one tab extends through the at least one slot and a portion of the carbon bottom.

8. The athletic shoe of claim 7, wherein the at least one tab is adhered to the carbon bottom to couple the carbon portion to the titanium portion.

9. An outsole for a cycling shoe, the cycling shoe including an upper having a toe section, a forefoot section, and a heel section, the outsole comprising:
a carbon fiber portion;
the carbon fiber portion comprising a carbon fiber bottom and an up turned outer rim;
the carbon fiber bottom having an inner edge defining an opening;
a titanium portion;
the titanium portion comprising a titanium bottom and an outer wall;
the outer wall having a top edge with at least one tab coupled to the top edge;
the at least one tab extends radially outward from the top edge, over the inner edge and over a portion of the carbon bottom; and
an adhesive between the at least one tab and the portion of the carbon bottom couples the titanium portion to the carbon fiber portion.

10. The outsole of claim 9, further comprising:
a plurality of studs coupled to the carbon fiber bottom.

11. The outsole of claim 9, further comprising:
a plurality of studs coupled to the titanium bottom.

12. The outsole of claim 11, further comprising:
a plurality of second studs coupled to the carbon fiber bottom.

13. The outsole of claim 9, further comprising:
at least one hole in the titanium bottom.

14. The outsole of claim 13, wherein the at least one hole comprises a plurality of holes.

* * * * *